US006637061B1

(12) United States Patent
Spracklin et al.

(10) Patent No.: US 6,637,061 B1
(45) Date of Patent: Oct. 28, 2003

(54) COMBINATION TOOL ASSEMBLY FOR BICYCLES AND METHOD OF USING SAME

(75) Inventors: Stacy T. Spracklin, Kenosha, WI (US); Wendell J. Woodruff, Walled Lake, MI (US); Gerald A. Wridt, Racine, WI (US); Richard L. Hopper, Kenosha, WI (US)

(73) Assignees: Snap-on Technologies, Inc., Lincolnshire, IL (US); Trek Bicycle Corporation, Waterloo, WI (US)

( * ) Notice: Subject to any disclaimer, the term of this patent is extended or adjusted under 35 U.S.C. 154(b) by 31 days.

(21) Appl. No.: 09/612,018

(22) Filed: Jul. 7, 2000

Related U.S. Application Data

(60) Provisional application No. 60/143,130, filed on Jul. 9, 1999.

(51) Int. Cl.[7] ..... B25B 13/00

(52) U.S. Cl. ..... 7/138; 7/165; 7/166

(58) Field of Search ..... 7/138, 165, 166, 7/167, 168, 170; 81/439, 440, 177.4, 490

(56) References Cited

U.S. PATENT DOCUMENTS

| | | | | | |
|---|---|---|---|---|---|
| 2,715,028 | A | * | 8/1955 | Dossie | 81/177.4 |
| 4,103,378 | A | | 8/1978 | Granados | |
| 4,477,936 | A | | 10/1984 | Weston | |
| 4,836,066 | A | | 6/1989 | Graham et al. | |
| 4,967,435 | A | | 11/1990 | Seals | |
| 5,003,656 | A | | 4/1991 | Loppnow | |
| D322,208 | S | | 12/1991 | Shaw | |
| 5,086,674 | A | | 2/1992 | Her | |
| 5,146,815 | A | | 9/1992 | Scott, III | |
| D331,498 | S | | 12/1992 | Chen | |
| D332,211 | S | | 1/1993 | Scott, III | |
| D332,384 | S | | 1/1993 | Dague | |
| 5,251,341 | A | | 10/1993 | Seals | |
| 5,303,439 | A | | 4/1994 | Seals | |
| 5,357,643 | A | | 10/1994 | Seals | |
| D354,215 | S | | 1/1995 | Seals | |
| 5,385,071 | A | | 1/1995 | Her | |
| D374,389 | S | | 10/1996 | Lin | |
| 5,588,169 | A | | 12/1996 | Chuang | |
| RE35,424 | E | | 1/1997 | Seals | |
| 5,632,056 | A | | 5/1997 | Hsiao | |
| D382,180 | S | | 8/1997 | Chuang | |
| 5,655,242 | A | | 8/1997 | Chuang | |
| 5,690,016 | A | | 11/1997 | Hwang | |
| 5,711,042 | A | | 1/1998 | Chuang | |
| 5,715,554 | A | | 2/1998 | Downs et al. | |
| 5,810,525 | A | * | 9/1998 | Ector, Sr. | 81/490 |
| 6,044,508 | A | * | 4/2000 | Chuang | 7/138 |
| 6,062,111 | A | * | 5/2000 | Wershe | 81/177.4 |
| 6,092,444 | A | * | 7/2000 | Hsiao | 81/440 |
| 6,112,351 | A | * | 9/2000 | Hawkins et al. | 7/138 |

* cited by examiner

*Primary Examiner*—James G. Smith
(74) *Attorney, Agent, or Firm*—Seyfarth Shaw

(57) ABSTRACT

The tool assembly includes a main metal body with three sockets respectively receiving the short legs of three differently-sized L-shaped wrenches. In stowed positions, the long legs of the wrenches lie against one side of the body in a nested configuration, the uppermost wrench being engageable with a retaining tab on the body to prevent movement of the wrenches axially of the sockets. The wrenches are pivotally movable about the axes of the sockets to unstowed positions, wherein they are movable axially of the sockets to either a removed condition, separated from the body, or a locked condition seated deeper in the sockets and retained against rotation. Dovetail-shaped tongues on opposite sides of the main body are respectively receivable in dovetail-shaped grooves on tire levers to mount the levers on the body, one of the levers holding the wrenches in their stowed positions. An O-ring encircles the parts of the assembly to provide additional retention. Formed on the body are open-end wrench jaws, a box wrench aperture, and a hex wrench lug, as well as a chain pin removal structure and spoke wrench slots.

20 Claims, 3 Drawing Sheets

10

COMBINATION TOOL ASSEMBLY FOR BICYCLES AND METHOD OF USING SAME

RELATED APPLICATION

This application claims the benefit of the filing date of copending U.S. Provisional Application No. 60/143,130, filed Jul. 9, 1999.

BACKGROUND

This application relates to combination or multi-purpose tools and, in particular, to such tools which are specially adapted for use in repairing and maintaining bicycles.

A number of multi-purpose or combination bicycle tools or tool kits have heretofore been provided. However, such prior tools have either omitted tool portions for performing certain essential bicycle repair or maintenance functions, have been of unusually complex and expensive construction, have had inconvenient shapes for storage when not in use, or have been inconvenient to use.

SUMMARY

There is provided a combination bicycle tool assembly which affords a comprehensive group of tool portions for dealing with most emergency repair and maintenance situations.

Another feature is the provision of a tool assembly of the type set forth, which includes tool portions which cooperate with one another to hold the tool assembly in a compact storage configuration.

Still another feature is the provision of a tool assembly of the type set forth which is convenient to use.

Yet another feature is the provision of a tool assembly of the type set forth, which is of relatively simple and economical construction.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the tool assembly, its construction and operation, and many of its advantages should be readily understood and appreciated.

DETAILED DESCRIPTION

Figure 1:
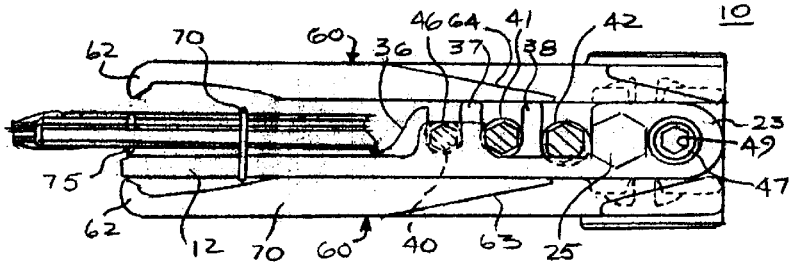
FIG. 1 is a top plan view of a combination tool assembly in its storage configuration.

Referring to FIGS. 1–4, there is illustrated a combination tool assembly, generally designated by the numeral 10. The tool assembly 10 includes a main body 11, which may be formed of a suitable metal, such as a suitable steel, and has a substantially flat main wall 12 with substantially parallel front and rear surfaces 13 and 14. The main wall 12 is narrowed and bifurcated at one end to define a pair of open-end wrench jaws 15 joined by a generally U-shaped throat 16 and having substantially parallel sides which can define first gripping surfaces 15*a* which are, in turn, joined by sloping shoulders 17 to more widely-spaced gripping surfaces 18, respectively on the jaws 15. Also formed through the main wall 12 is a hexagonal box wrench opening 19. The narrowed end of the wall 12 has an arcuately sloping lower edge 20 terminating in a hook 21, which may be used as a bottle opener or for other purposes.

Integral with the main wall 12 at its other end and extending from the rear surface 14 thereof substantially perpendicular thereto is a relatively thick end wall 22, having a projection 23 extending longitudinally outwardly from the upper end thereof and having an internally threaded bore 24 extending therethrough substantially parallel to the end wall 22. Projecting upwardly from the end wall 22 adjacent to one end of the bore 24 is a hexagonal wrenching lug 25. Formed on the front and rear surfaces of the end wall 22 and the projection 23 are longitudinally extending ribs or tongues 26, each dove-shaped in transverse cross section, and each having a slot 27 therethrough in a direction parallel to the bore 24. Projecting longitudinally outwardly from the end wall 22 at spaced apart locations beneath the projection 23 are a pair of chain supports 28, each having a generally U-shaped notch 29 in the distal end thereof (see FIG. 2). Integral with the end wall 22 and projecting longitudinally outwardly therefrom at the lower end therefrom is a flange 30, which has a notch 31 formed in the distal end thereof in alignment with the chain support notches 29. The flange 30 also projects forwardly and rearwardly from the end wall 22 and has spoke wrench slots 32 and 33 formed in the front and rear ends thereof, respectively.

The body 11 also has a thick bottom wall 35 integral with the main wall 12 and with the end wall 22, and extending along the lower edge of the main wall 12 from the end wall 22 substantially to the hook 21. Integral with the bottom wall 35 and projecting upwardly therefrom along the rear surface 14 of the main wall 12 at longitudinally spaced locations are an end wall 36 and partitions 37 and 38 which extend progressively greater distances from the bottom wall 35. Progressively larger diameter bores 40, 41 and 42 are formed through the end wall 35, respectively in alignment with the spaces between the walls 22 and 36 and the partitions 37 and 38 and substantially parallel thereto, for respectively forming sockets, as will be explained below. Formed in the upper surface of the bottom wall 35, respectively in alignment with the bores 40–42, are generally U-shaped notches 43, 44 and 45.

Projecting rearwardly from the rear surface 14 of the main wall 12 at the upper edge thereof is a generally rectangular retaining tab 46. An elongated screw 47 is threadedly engaged in the bore 24 and has an elongated pin 48 projecting axially from the lower end thereof and a hexagonal recess 49 (FIGS. 1 and 2) formed axially in the upper end thereof, the parts being so dimensioned that, when thus assembled, the pin 48 is substantially coaxial with the chain support notches 29 and the flange notch 31.

Figure 2:
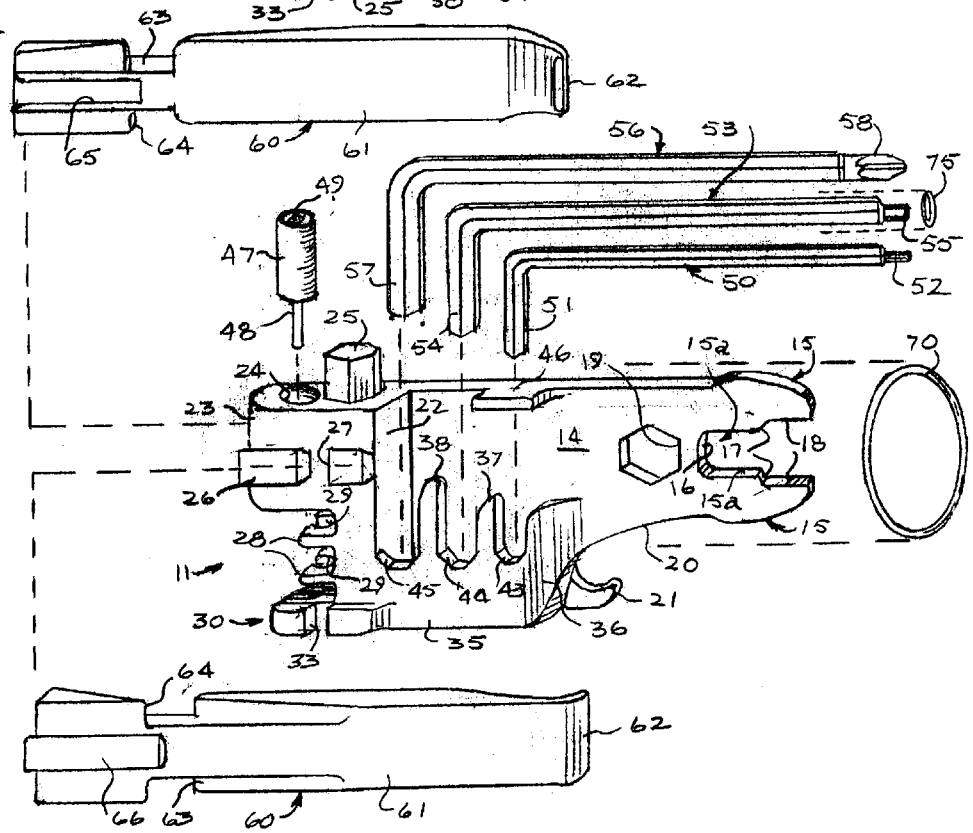
FIG. 2 is an exploded perspective view of the tool assembly of FIG. 1.
Figure 5:
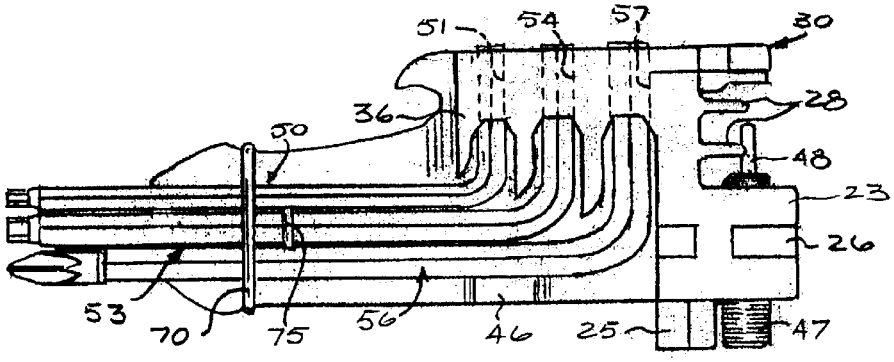
FIG. 5 is a rear elevational view of the body and screw of FIG. 2 with Allen-type L-shaped wrenches stored thereon.

Referring in particular to FIGS. 2 and 5, the tool assembly 10 also includes three generally L-shaped hex wrenches, including a small wrench 50 having a large hex end 51 and a small hex tip 52, a medium wrench 53 having a large hex end 54 and a smaller hex tip 55, and a large hex wrench 56, having a large hex end 57 and a tip 58, which may be a screwdriver tip, such as a no. 2 Phillips-head tip. The large ends 51, 54 and 57 of the hex wrenches are, respectively, dimensioned to be received in the bores 40–42, with the long legs of the wrenches 50, 53 and 56 lying against the rear surface 14 of the main wall 12 in a stowed or storage position, illustrated in FIG. 5. When all three wrenches are thus stored, the small wrench 50 will be supported on the end wall 36, and the other wrenches will be supported on the small wrench 50. It will be appreciated that the end wall 36 and the partitions 37 and 38 limit the depth of insertion of the wrenches in the bores 40–42 so that, in the storage position, the large ends 51, 54 and 57 of the wrenches do not extend below the lower end of the bottom wall 35. It will be seen that in this storage position, the retaining tab 46 inhibits accidental removal of the large wrench ends axially from the bores 40–42.

Figure 7:
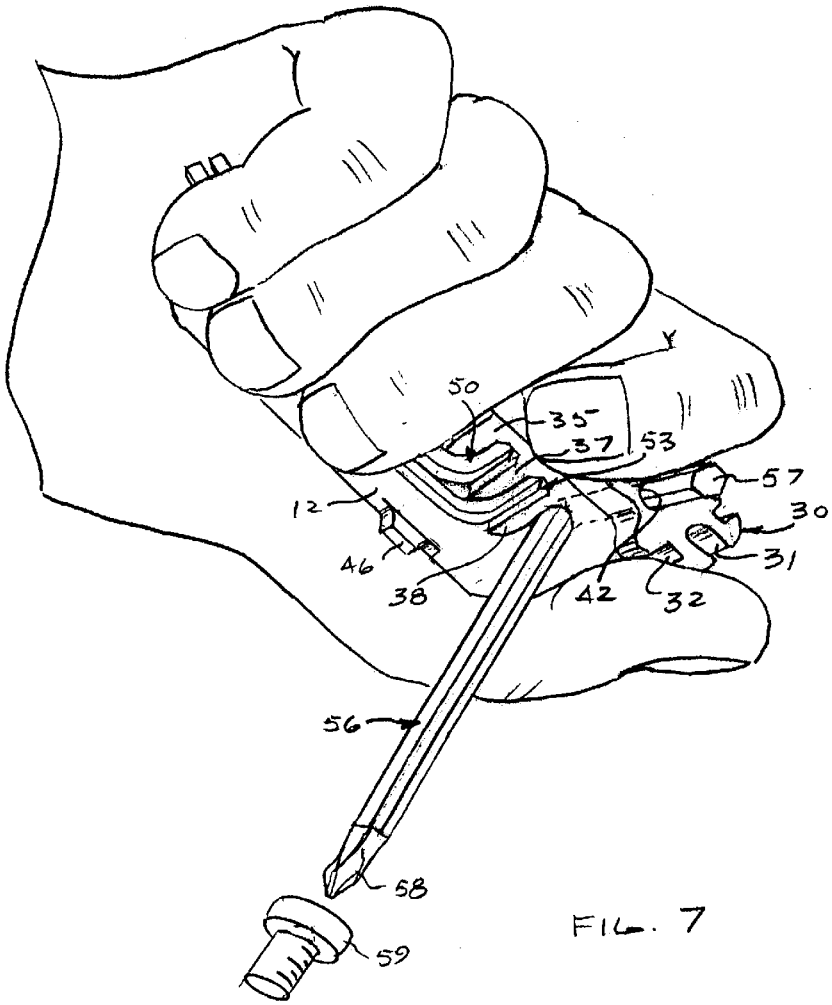
FIG. 7 is a perspective view illustrating another use of the tool assembly of FIGS. 1 and 2.
Figure 3:
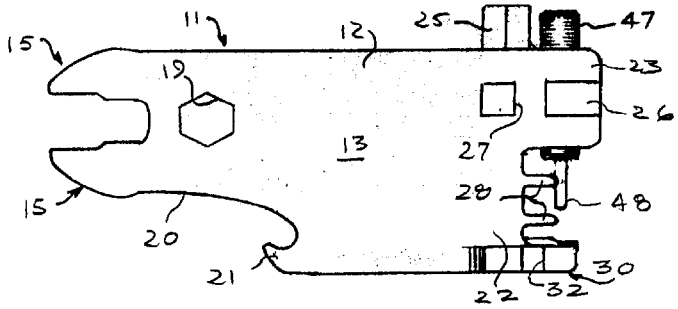
FIG. 3 is a front elevational view of the main body and chain pin removal screw of the tool assembly of FIG. 2.
Figure 4:
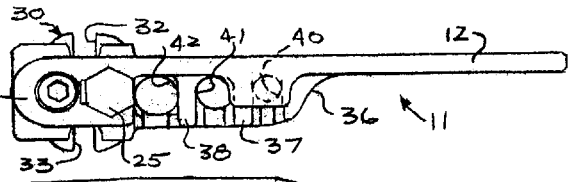
FIG. 4 is a top plan view of the body and screw of FIG. 3.

In order to remove any of the hex wrenches 50, 53 and 56, the large wrench 56 must first be swung away from the storage position to an unstowed position wherein the long leg of the wrench is substantially perpendicular to the main wall 12. (see FIG. 7) This will permit removal of the large wrench 56. In order to remove either of the medium or small wrenches 53 and 50, overlying wrenches must first be swung out of the way to their unstowed positions, but once this is done, there is sufficient clearance beneath the retaining tab 46 to permit removal of either of the medium and small wrenches 53 and 50 without pivoting it.

Figure 8:
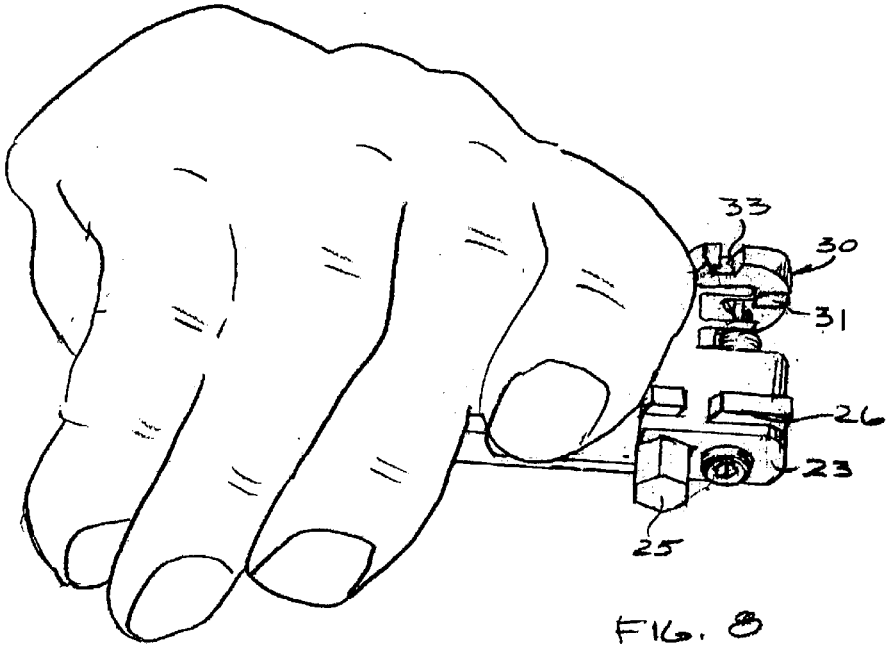
FIG. 8 is perspective view illustrating another use of the tool assembly of FIGS. 1 and 2.

For purposes of using the hex wrenches 50, 53 and 56, if the large end of the wrench is to be engaged with a fastener, the wrench is completely removed from the body 11 and the long end of the wrench is used as a handle in the normal fashion. However, if one of the tips 52, 55 or 58 is to be engaged with a fastener, additional leverage may be obtained by simply swinging the selected wrench until it is in its unstowed position extending perpendicular to the main wall 12, allowing it to drop in the associated one of the bores 40–42 to a locked condition, wherein the long end of the wrench seats in the associated one of the notches 43–45 and is inhibited from rotation or pivotal movement by the flanking ones of the end walls 22 and 36 and the partitions 37 and 38. The body 11 may then be used as a handle, in the manner illustrated in FIG. 7, wherein the tip 58 is shown disposed for engagement with an associated fastener 59. It will be appreciated that the body 11 will also serve as a handle when wrenching with the hex lug 25, as illustrated in FIG. 8.

Figure 6:
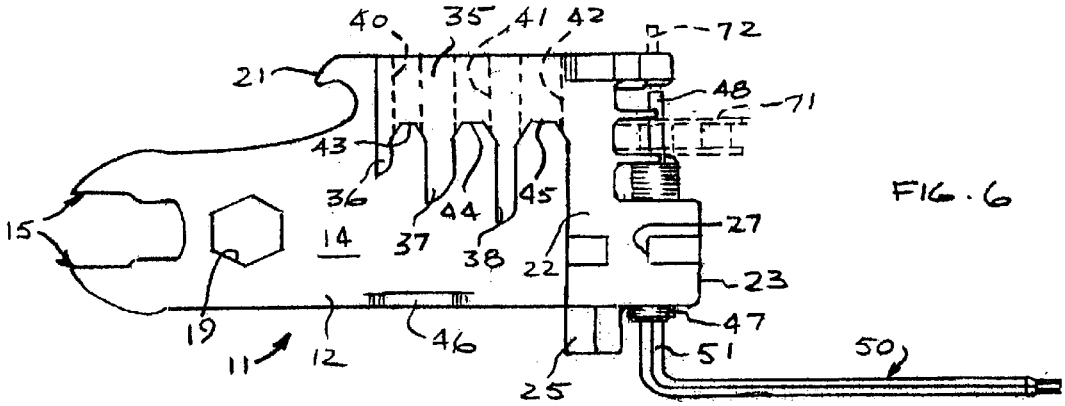
FIG. 6 is a view similar to FIG. 5, illustrating the use of one of the wrenches to drive the chain pin removal screw.

The tool assembly 10 may also be used as a spoke wrench, utilizing a selected one of the notches 32 and 33, clearance for the spoke being provided through the ribs 26 by the slots 27. For purposes of chain link pin removal, the associated chain (see FIG. 6) is seated between the chain supports 28 with the pin to be removed in axial alignment with the screw pin 48. The large end 51 of the small hex wrench 50 is then engaged in the screw recess 49 for advancing the screw 47 to drive the chain pin out with the screw pin 48 in a known manner, pin clearance being provided by the notch 31 in the flange 30 (see FIG. 8).

The combination tool assembly 10 also includes a pair of tire levers 60, which may be formed of a suitable plastic material and are of identical construction, wherefore only one will be described in detail. Each of the tire levers 60 is of the type disclosed in copending and commonly-owned U.S. application Ser. No. 09/078,910, filed May 14, 1998 and entitled "Versatile Tire Lever," now U.S. Pat. No. 5,979,532, the disclosure of which is incorporated herein by reference. Thus, only so much of the construction and use of the tire levers 60 will be described herein as is necessary for an understanding of the present invention. The tire lever 60 has an elongated, generally rectangular body 61 with a curved, reduced-thickness tip 62 at one end thereof. Slanted, spoke-engaging slots 63 and 64 are respectively formed in the opposite side edges of the body 61. The end of the body 61 opposite the tip 62 is provided along its lower surface with a longitudinally extending rectangular groove 65, dovetail-shaped in transverse cross section, and along its upper surface with a longitudinally extending and upwardly projecting rectangular rib 66.

The ribs or tongues 26 on the body 11 are, respectively, dimensioned to be slidably received in the grooves 65 of the two tire levers 60, for mounting the tire levers 60 on the body 11 in a storage position, as illustrated in FIG. 1. If desired, the ribs 26 could be dimensioned to provide a wedging or friction fit in the grooves 65. It will be seen that, when the parts are thus assembled, one of the tire levers 60 serves to retain the hex wrenches 50, 53 and 56 in place, and the entire assembly provides a compact, generally rectangular configuration. In order to further ensure retention of the parts in the assembled configuration, there may be provided an elastic O-ring 70, which can encircle the assembled main wall 12 and wrenches 50, 53 and 56 in the manner shown in FIGS. 1 and 5. An O-ring 75 (FIGS. 2 and 5) may be provided on the long lead of the wrench 53 to serve as a spacer and inhibit rattling of the parts in the stowed position.

The matter set forth in the foregoing description and accompanying drawings is offered by way of illustration only and not as a limitation. While a particular embodiment has been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

We claim:

1. A combination tool assembly comprising:

a main body having plural spaced sockets therein, plural generally L-shaped wrench tools respectively removably disposable in the sockets for pivotal movement between stowed and unstowed positions, and retaining structure on the body engageable with at least one of the wrench tools for retaining the wrench tools in their stowed positions, the retaining structure including a lever tool removably carried by the body.

2. The tool assembly of claim 1, wherein the wrench tools are of different sizes and are arranged in a nested configuration of decreasing sizes in their stowed positions, the retaining structure including a flange on the body.

3. The tool assembly of claim 1, wherein the retaining structure includes an elastic member encircling the wrench tools and the main body.

4. The tool assembly of claim 1, wherein the main body includes wall structures flanking each socket, the wall structures being of varying heights and being engageable by the wrench tools for limiting the depth of insertion of wrench tool in the sockets.

5. The tool assembly of claim 4, wherein the main body includes notches respectively adjacent to the sockets, the wrench tools being translationally movable in said sockets between the unstowed positions and locked positions respectively supported by the notches, the wrench tools in their locked positions being engageable with the wall structures to prevent pivotal movement.

6. The tool assembly of claim 1, wherein the main body includes a wrenching lug projecting therefrom and adapted for wrenching engagement in an associated female wrenching surface.

7. A combination tool assembly comprising:

a main body having plural spaced sockets therein, plural generally L-shaped wrench tools respectively removably disposable in the sockets for pivotal movement between stowed and unstowed positions, retaining structure on the body engageable with at least one of the wrench tools for retaining the wrench tools in their stowed positions, and chain supports projecting from the main body for supporting an associated bicycle chain link, and a link pin removal tool carried by the body and rotatable with the use of a predetermined one of the wrench tools for driving a chain link pin from the associated chain link.

8. A combination tool assembly comprising:

a main body having fastener-engaging wrenching surfaces thereon, the body having a tongue portion projecting therefrom, the tongue portion having a slot formed therein, the main body having a bicycle spoke wrench slot therein disposed in alignment with the tongue portion slot so that the tongue portion slot affords clearance for a spoke being wrenched with the spoke wrench slot; and a lever member having a groove formed therein, the tongue portion being receivable in the groove for removably mounting the lever member on the body.

9. The tool assembly claim in 8, wherein each of the tongue and the groove is elongated.

10. The tool assembly of claim 8, wherein the tongue portion is a first tongue portion disposed on a first side of the main body and the lever member is a first lever member, and further comprising a second tongue portion on the opposite side of the body, and a second lever member having a groove formed therein, the second tongue portion being receivable in the groove of the second lever member for removably mounting the second lever member on the body.

11. The tool assembly of claim 8, wherein the lever member is a tire lever for use in removing a bicycle tire from an associated wheel rim.

12. A combination tool assembly comprising:

a main body having open end wrench jaws formed thereon and a box wrench opening formed therethrough and bicycle spoke wrench slots formed therein, a plurality of tools removably mounted on the body in stowed positions, and an elastic member encircling the body and the tools and resiliently retaining the tools in their stowed positions.

13. The tool assembly of claim 12, wherein the elastic member is an O-ring.

14. The tool assembly of claim 12, wherein the tools includes L-shaped wrench tools.

15. The tool assembly of claim 14, and further including a lever tool.

16. The tool assembly of claim 5, and further including a second lever tool, the lever tools respectively being mounted on opposite sides of the main body.

17. A method of using a combination tool assembly which includes a main body with plural sockets therein, and plural L-shaped wrench tools with legs respectively receivable in the sockets for pivotal movement about the axes of the legs between stowed and unstowed positions and for translational movement axially of the legs between the unstowed positions and locked conditions retaining the wrench tools against rotation, the method comprising:

pivoting a wrench tool from its stowed position to its unstowed position, then moving the unstowed wrench tool from its unstowed position to its locked condition, then grasping the body as a handle for manipulation of the locked wrench tool, and mounting a lever tool on the main body in engagement with at least one of the wrench tools for retaining the wrench tools in their stowed positions.

18. The method of claim 17, wherein the wrench tools are movable axially of the legs between the unstowed positions and removed conditions separated from the main body, the method including moving a wrench tool from its unstowed positions to its removed condition, then using the removed wrench tool independently of the main body.

19. The method of claim 17, and further comprising fitting an elastomeric band around the wrench tools and the main body for retaining the tool assembly in a storage condition.

20. A method of using a combination tool assembly which includes a main body with plural sockets therein, and plural L-shaped wrench tools with legs respectively receivable in the sockets for pivotal movement about the axes of the legs between stowed and unstowed positions and for translational movement axially of the legs between the unstowed positions and locked conditions retaining the wrench tools against rotation, the method comprising:

pivoting a wrench tool from its stowed position to its unstowed position, then moving the unstowed wrench tool from its unstowed position to its locked condition, then grasping the body as a handle for manipulation of the locked wrench tool, wherein the main body includes a wrenching lug projecting therefrom, and further comprising grasping the main body as a handle for manipulation of the wrenching lug.

* * * * *